US009498880B2

(12) United States Patent
Scholtz et al.

(10) Patent No.: US 9,498,880 B2
(45) Date of Patent: Nov. 22, 2016

(54) BICYCLE SERVICE RACK

(71) Applicant: Everlast Climbing Industries, Inc., Chattanooga, TN (US)

(72) Inventors: Rolf W. Scholtz, Minneapolis, MN (US); Joel Greenblatt, Wauwatosa, WI (US)

( * ) Notice: Subject to any disclaimer, the term of this patent is extended or adjusted under 35 U.S.C. 154(b) by 904 days.

(21) Appl. No.: 13/781,680

(22) Filed: Feb. 28, 2013

(65) Prior Publication Data

US 2013/0219705 A1 Aug. 29, 2013

Related U.S. Application Data

(63) Continuation-in-part of application No. 29/414,067, filed on Feb. 24, 2012, now Pat. No. Des. 680,914.

(51) Int. Cl.
*B25H 1/00* (2006.01)

(52) U.S. Cl.
CPC ..... *B25H 1/0014* (2013.01); *Y10T 29/52* (2015.01)

(58) Field of Classification Search
CPC ..... B25B 11/02; B23Q 13/00
See application file for complete search history.

(56) References Cited

U.S. PATENT DOCUMENTS

| | | | | |
|---|---|---|---|---|
| 542,964 | A | 7/1895 | Le Fevre | |
| 598,040 | A | 1/1898 | Webster | |
| 653,519 | A | 7/1900 | Masters | |
| 2,462,980 | A * | 3/1949 | Litt | F04B 33/005 16/110.1 |
| 3,675,784 | A | 7/1972 | John | |
| D281,199 | S | 10/1985 | Prawl | |
| D283,414 | S | 4/1986 | Shedden | |
| D288,995 | S | 3/1987 | Cooper | |
| 5,222,707 | A | 6/1993 | Myers | |
| D337,082 | S | 7/1993 | Hellesoe | |
| D348,966 | S | 7/1994 | Guyton | |
| 5,497,967 | A | 3/1996 | Gantois | |
| D373,519 | S | 9/1996 | Escalante | |
| D373,884 | S | 9/1996 | Price | |
| D388,925 | S | 1/1998 | Hulegaard et al. | |
| 5,765,821 | A | 6/1998 | Janisse et al. | |
| 5,996,814 | A | 12/1999 | Workman et al. | |
| D445,273 | S | 7/2001 | Brown | |
| 6,305,667 | B1 * | 10/2001 | Heller | B61K 5/02 254/423 |
| 6,558,129 | B2 * | 5/2003 | Wang | F04B 33/005 417/63 |
| D490,289 | S | 5/2004 | Chuang | |
| 6,926,254 | B1 * | 8/2005 | Nymann | B25H 1/0007 254/124 |
| 7,311,048 | B2 | 12/2007 | Kopala, Jr. | |
| D595,618 | S | 7/2009 | Dallaire | |
| 7,575,207 | B2 | 8/2009 | Chuang | |
| D599,714 | S | 9/2009 | Neff | |
| 7,712,614 | B2 | 5/2010 | Carlson et al. | |
| D660,749 | S | 5/2012 | Strayer | |

(Continued)

OTHER PUBLICATIONS

Derovations Fixit, Feb. 23, 2012, 4 pages.

(Continued)

*Primary Examiner* — Lee D Wilson
(74) *Attorney, Agent, or Firm* — McAndrews, Held & Malloy, Ltd.

(57) ABSTRACT

An example bicycle service rack includes: a main body extending vertically from a single base; a bicycle mount coupled to the main body, the bicycle mount being configured to hold a bicycle; at least one cable coupled to the main body, the at least one cable being coupled to a bicycle tool; and an air pump coupled to the main body, the air pump being configured to pump air into a tire of the bicycle.

19 Claims, 9 Drawing Sheets

(56) References Cited

U.S. PATENT DOCUMENTS

| | | | | |
|---|---|---|---|---|
| D680,914 | S * | 4/2013 | Greenblatt | B25B 1/00 D12/115 |
| 9,239,046 | B2 * | 1/2016 | Wang | G01L 23/10 |
| 2006/0208240 | A1 * | 9/2006 | Spittle | B66C 23/48 254/8 B |
| 2013/0219705 | A1 * | 8/2013 | Scholtz | B25H 1/0014 29/650 |

OTHER PUBLICATIONS

Madrax Catalog, Bike Racks, New Products, copyright 2012 Graber Manufacturing, Inc., 44 pages.

Bike Fixtation, Public Work Stand, copyright 2013 Bike Fixtation LLC, 2 pages.

University Times, University of Pittsburgh, "Campus Adds Amenities for Cyclists" published May 3, 2012, 1 page.

Chester, Brett, Denver Westword Blogs, "Whole Foods Market on Capitol Hill Installs Dero Fixit Bike Stand" posted Jun. 11, 2012, 4 pages.

Streetscapes, "Bicycle Fixit Station—FT—GA" copyright 2013 Streetscapes, Inc., 1 page.

Exhibit A—Derovations Fixit, Admitted Prior Art as of the earliest priority date for the present patent application.

* cited by examiner

BICYCLE SERVICE RACK

RELATED APPLICATION

This application is a continuation-in-part of U.S. patent application Ser. No. 29/414,067 filed on Apr. 24, 2012, the entirety of which is hereby incorporated by reference.

BACKGROUND

Bicycles are a popular form of transportation. As the highways become more congested and green technologies are encouraged, more individuals are deciding to use their bicycles for commuting. As a mode of transportation, bicycles are relatively simple devices. However, there are times when bicycles must be serviced. In some instances, repair is necessary when a bicycle is away from the individual's residence or bicycle shop.

SUMMARY

In one non-limiting aspect, an example bicycle service rack includes: a main body extending vertically from a single base; a bicycle mount coupled to the main body, the bicycle mount being configured to hold a bicycle; at least one cable coupled to the main body, the at least one cable being coupled to a bicycle tool; and an air pump coupled to the main body, the air pump being configured to pump air into a tire of the bicycle.

DETAILED DESCRIPTION

Figure 1:
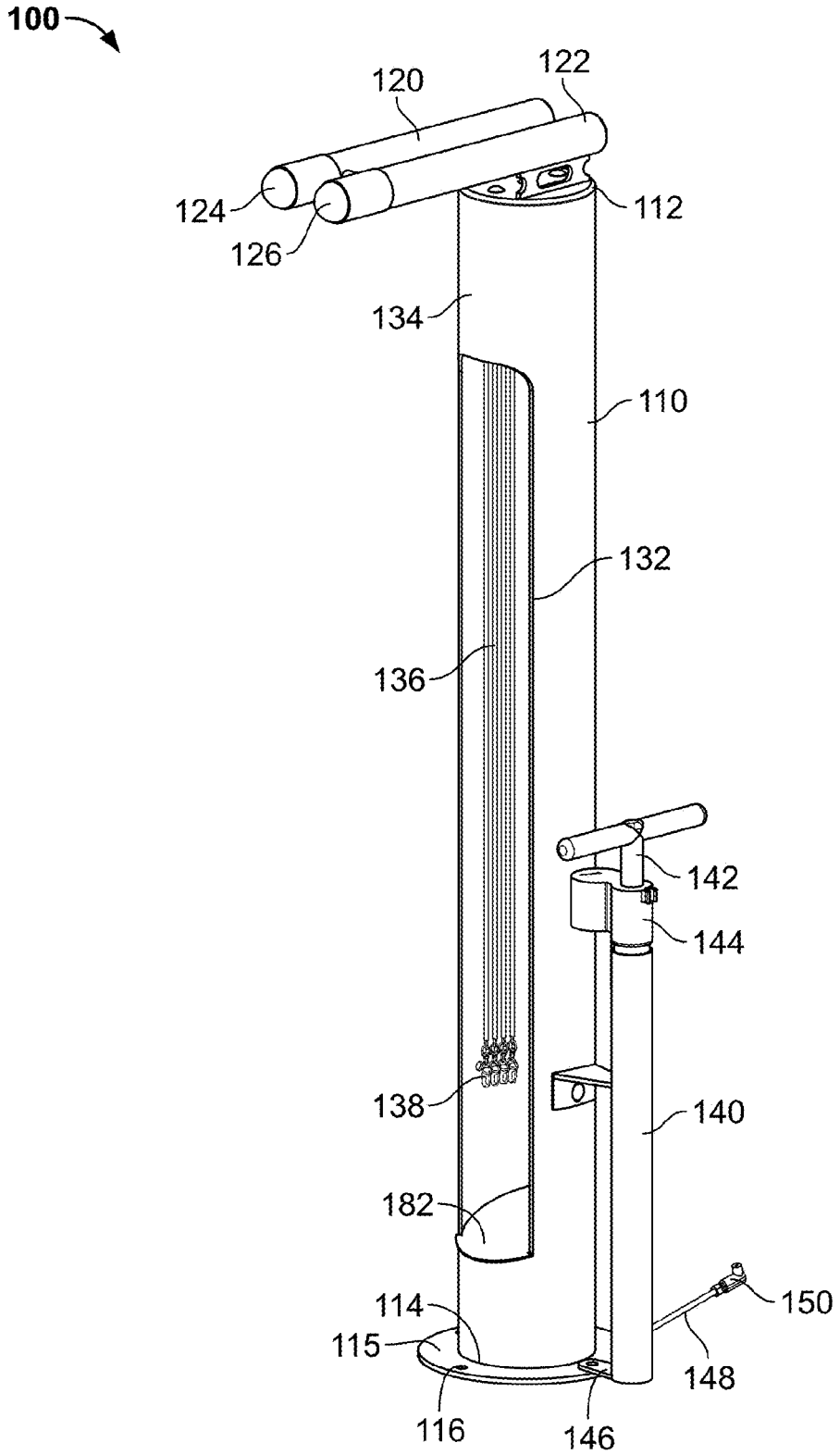
FIG. 1 shows a front perspective view of an example bicycle service rack.
Figure 2:
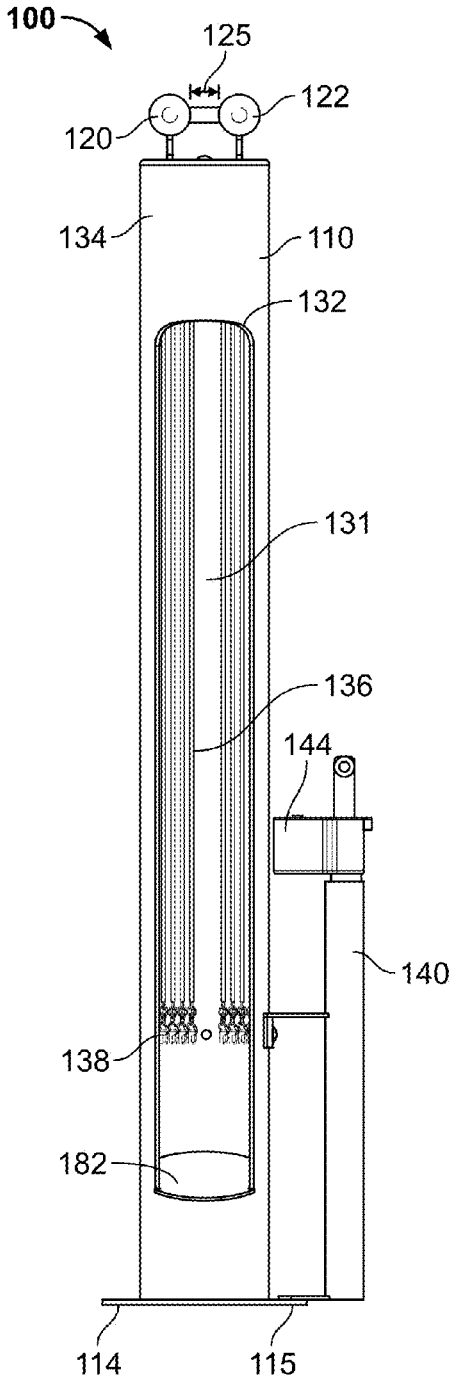
FIG. 2 shows a front view of the bicycle service rack of FIG. 1.
Figure 3:
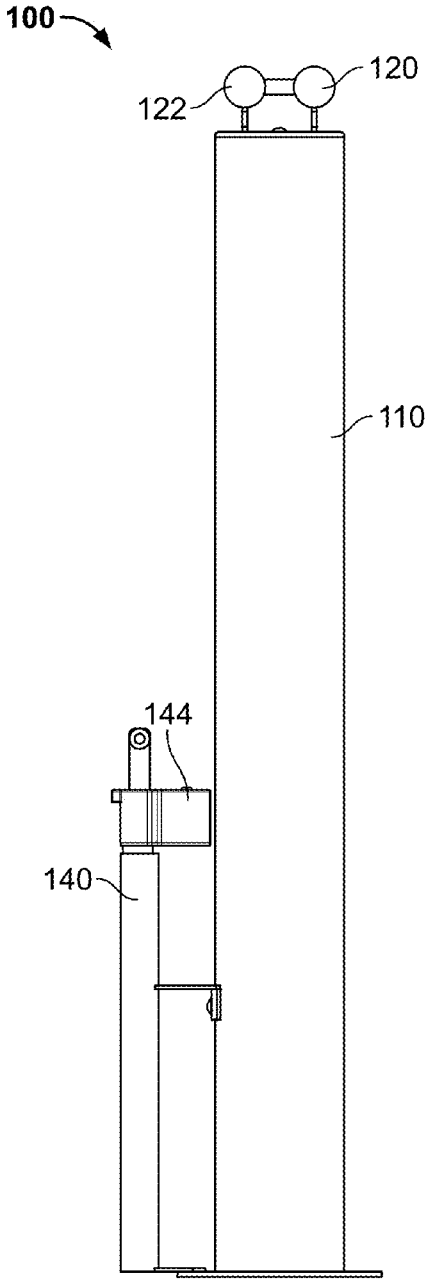
FIG. 3 shows a rear view of the bicycle service rack of FIG. 1.
Figure 4:
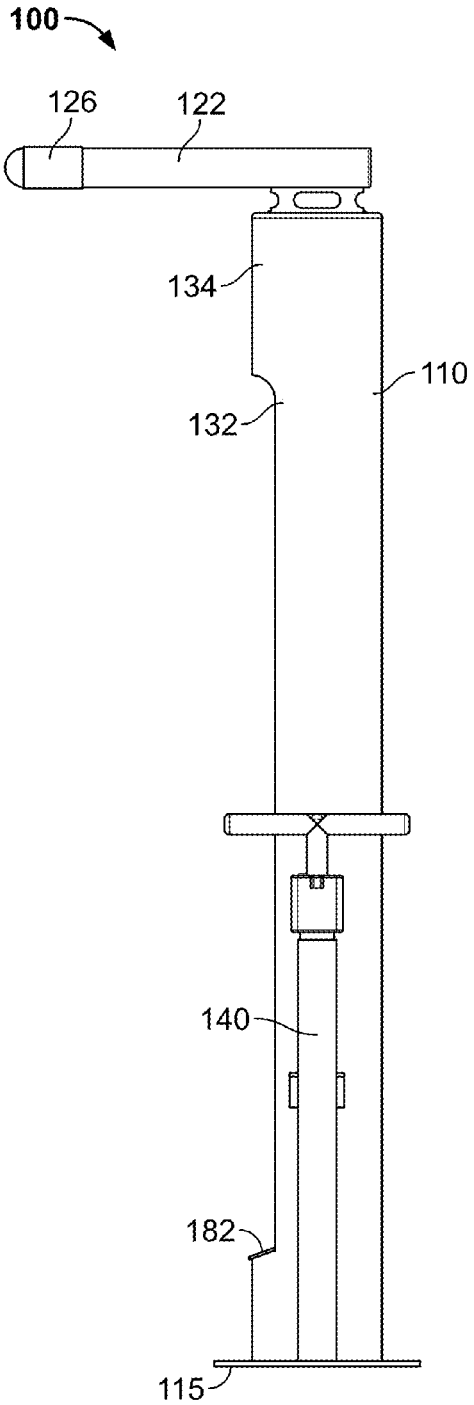
FIG. 4 shows a first side view of the bicycle service rack of FIG. 1.
Figure 5:
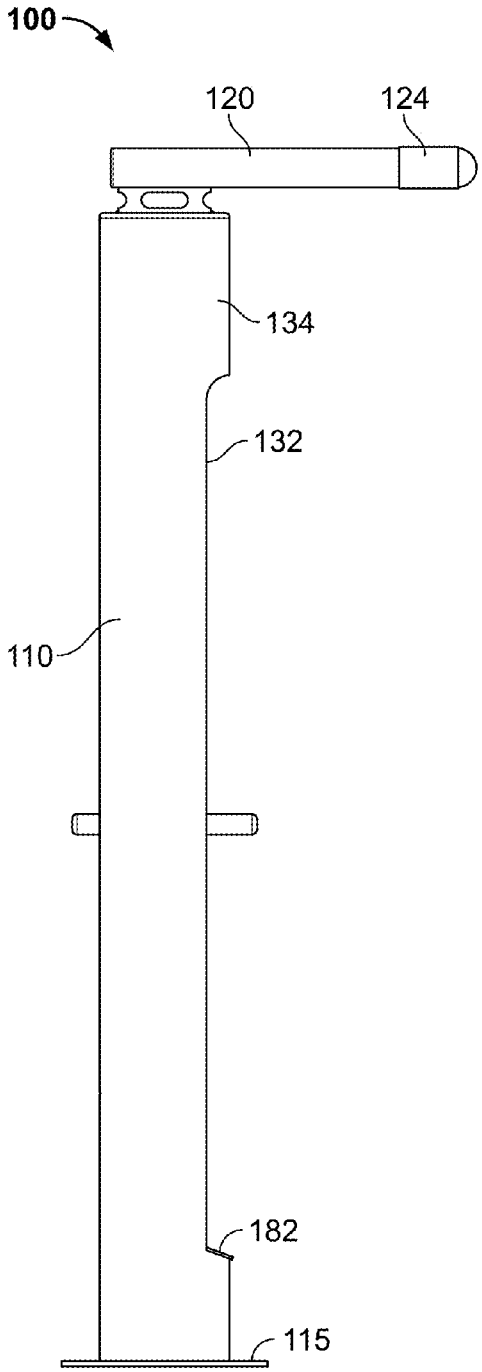
FIG. 5 shows a second side view of the bicycle service rack of FIG. 1.
Figure 6:
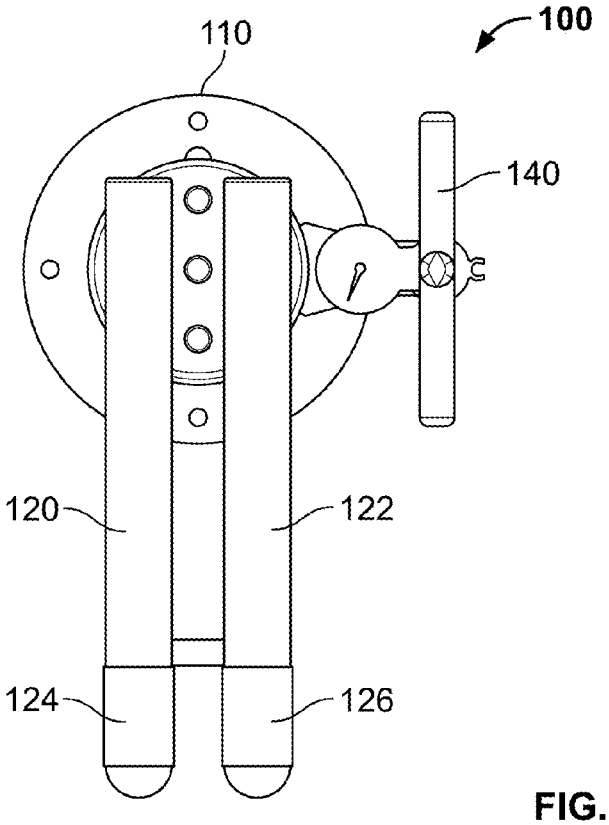
FIG. 6 shows a top view of the bicycle service rack of FIG. 1.
Figure 7:
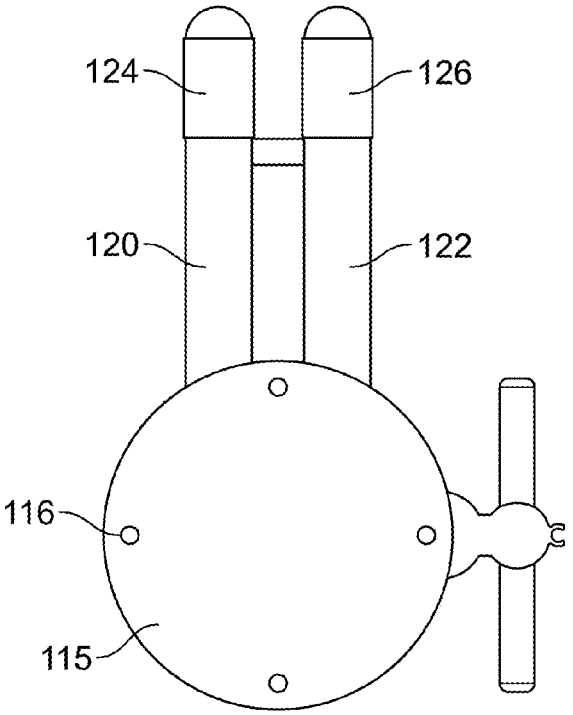
FIG. 7 shows a bottom view of the bicycle service rack of FIG. 1.

The present disclosure relates generally to bicycle service racks. In example embodiments, the bicycle service racks provide a plurality of components that allow one to service (e.g., repair and/or maintain) a bicycle or similar device. In some examples, the bicycle service racks are configured to allow the bicycle service rack to be located in an urban environment, such as along a bicycle path, so that riders can conveniently perform service as required while using the bicycles.

Referring now to FIGS. 1-7, a first example bicycle service rack 100 is shown.

The bicycle service rack 100 includes an example main body 110 having a first end 112 and a second end 114. In this example, the main body 110 is a cylindrical tube, although other shapes can be used, such as rectangular, oblong, etc. shapes or other structures can comprise the main body 110.

In one example embodiment, the main body 110 is hollow and forms an opening 132 to access an interior 131 of the main body 110. Positioned within the interior 131 is a plurality of cables 136 with a plurality of tools 138 affixed thereto. Examples of such tools include assorted screwdrivers, wrenches (e.g., Allen wrenches), tire levers, etc., but can also include service products, such as lubricants, tire plugs, etc. The cables 136 allow one or more of the tools 138 to be extended from the main body 110 for use in servicing a bicycle, while assuring that the tools 138 are not lost or stolen.

Figure 14:
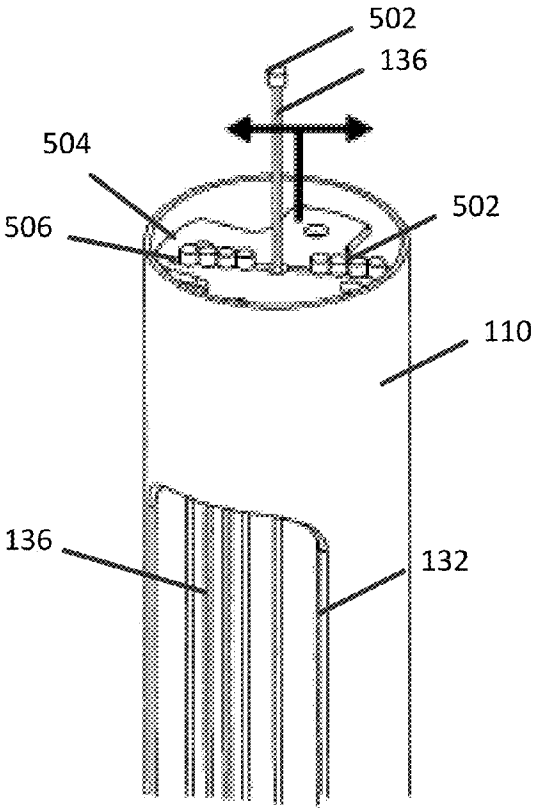
FIG. 14 is an enlarged view of a portion of a main body of the bicycle service rack of FIG. 1.

In this example, the cables 136 are positioned within the interior 131 to protect and house the tools 138. In addition, the cables 136 extend upwards into an upper portion 134 of the interior 131, whereat the cables 136 are attached to the main body 110. See FIG. 14. In this configuration, the cables 136 each include a head portion 502. The cables 136 are extended through a slot 506 formed in a bracket 504 that is positioned in the main body 110. The head portion 502 of each cable 136 is larger than the slot 506, so that the head portion 506 cannot fit through the slot 506, thereby suspending the cables 136 from the bracket 504. When the support members 120, 122 are thereupon connected to the main body, the cables 136 are secured so that tampering of the cables 136 is not possible, since the bracket 504 is inaccessible from the top.

Such a configuration is advantageous to protect the cables 136 from the weather, as well as from detachment and/or tampering of the cables 136. In other embodiments, the tools 138 may be connected to retractable cables that, when not in use, retract into the interior 131 or other portion of the main body 112. The tools 138 may also include magnets thereon to hold the tools to the main body 110 when not being used or to prevent them from interfering with use of other tools.

Other configurations are possible. For example, in an alternative design, the cables 136 are exposed, and the ends of the cables 136 opposite to that of the tools are protected. In other examples, the tools can be coupled to other components, such as having the tools coupled to other portions of the main body. Additional details about the example tools are provided below.

A bottom 182 of the interior 131 is slanted so that any moisture (e.g., rain or snow) or other liquids that enter the interior 131 are directed out of the interior 131.

The first end 112 of the main body 110 is coupled to support members 120, 122. The support members 120, 122 extend generally perpendicularly to the main body 110 and form a space 125 therebetween. In this example, the space 125 is sized to receive a portion of a bicycle, such as a seat post, to allow the bicycle to be rested upon the bicycle service rack 100 during service. See, e.g., FIGS. 7-8. In this example, the support members 120, 122 include end caps 124, 126 made from a material that resists scratches and minimizes damage to objects that contact the support members 120, 122. The support members 120, 122 can be coated or otherwise formed from materials that resist scratching and minimize any damage associated with contact with a bicycle mounted thereon. Other examples of support members 120, 122 are possible. For example, the bicycle service rack may include, as an alternative to support members 120, 122, a C-clamp that can hold various portions of a bike, such as the frame or tire while the bike is serviced.

In one alternative, the first end 112 can be rotatably-mounted to the main body 110 so that the first end 112 and attached support members 120, 122 can be rotated about an axis of the main body 110. For example, the support members 120, 122 can be rotated into the 3, 6, and 9 o'clock positions. In a same or another alternative, the first end 112 can include one or more supports that extend upward from the main body to allow a height at which the support members 120, 122 are positioned to be adjusted. In this manner, the bicycle service rack 100 can be configured to service bikes of different sizes and accommodate users of different heights.

The second end 114 of the main body 110 defines a base 115 upon which the bicycle service rack 100 can be mounted. For example, the base 115 includes a plurality of holes 116 through which bolts (not shown) can be extended to affix the bicycle service rack 100 to the ground. In these examples, the bicycle service rack 100 is permanently affixed so that it is not meant to be moved by users of the bicycle service rack 100.

In some examples, the base 115 is a single base. In other words, the footprint for the bicycle service rack 100 is minimized by using a single base 115 that is connected to the ground. For example, the bicycle service racks may include the single base 115 upon which all of the components (e.g., the main body 110) is connected. Other configurations are possible, such as a bicycle service rack 100 using multiple bases 115.

In alternative embodiments, the bicycle service rack 100 could have multiple bases 115 arranged closely together to minimize the footprint of the bicycle service rack 100. For example, in an embodiment with multiple bases 115, those bases 115 would be approximately less than two feet apart, and preferable less than approximately one and one-half feet apart, more preferably less than approximately one foot apart, and even more preferably less than approximately six inches apart. The footprint of the bicycle service rack 100 is thereby minimized by employing a single base or, in an embodiment with multiple bases, by keeping the bases 115 close together.

The bicycle service rack 100 also includes a pump unit 140 that is affixed to the main body 110 by brackets 144, 146. The brackets 144, 146 rigidly hold the pump unit 140 so that it cannot be removed by users of the bicycle service rack 100. In another example, the bolt(s) holding the bracket 146 can be positioned under the main body 110 so that it is not accessible when the bicycle service station 100 is installed, thereby resisting removal of the pump unit 140. In some embodiments, the position of the pump unit 140 relative to the main body 110 can be altered when installed, so that the pump unit 140 is positioned in the 3, 6, or 9 o'clock positions relative to the main body 110.

The pump unit 140 is removable during shipping, so that the pump unit 140 can be located within the interior 131 of the main body 110 to reduce the size of the packaging needed for the bicycle service rack 100.

The pump unit 140 is an air pump that can be used to service bicycles, such as by providing air to pump up the bicycles' tires. In this example, the pump unit 140 includes a hose 148 with an air nozzle 150 that is configured to be affixed to the stem of a bicycle tire. The user can thereupon actuate a pump handle 142 (e.g., move the pump handle 142 up and down) to force air from the pump unit 140 and into the tire.

In one alternative, the main body 110 also includes a QR code 192. The QR code 192 can be read by computers and smartphones. The QR code 192 can provide information, such as links to videos and/or instructions on bike maintenance. For example, the QR code 192 can be read by a user's smartphone, and the result can be to provide the user with a video on how to change a flat tire on a bicycle, using the tools 136 provided by the bicycle service rack 100. Multiple QR codes or similar information can be provided.

Figure 8:
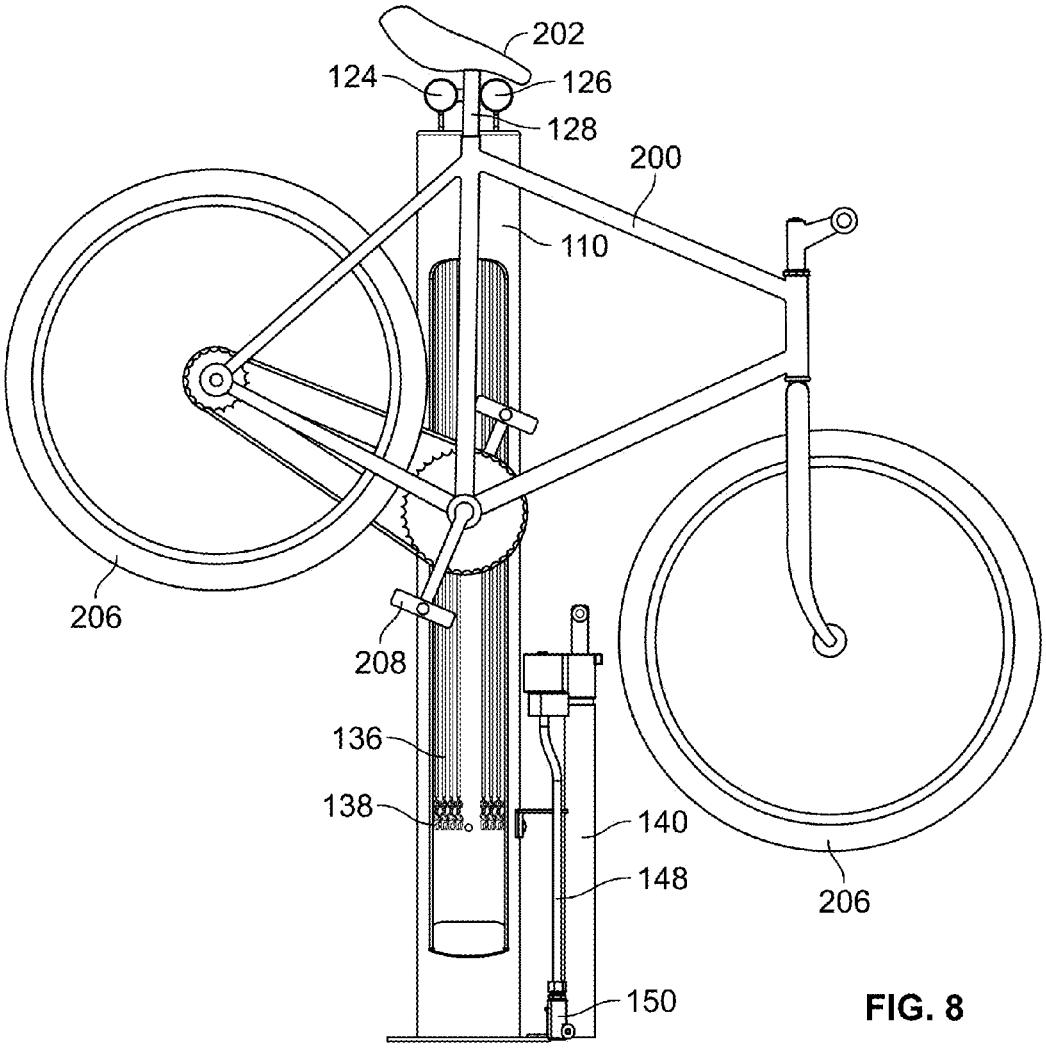
FIG. 8 shows another from view of the bicycle service rack of FIG. 1 including a bicycle mounted thereon.
Figure 9:
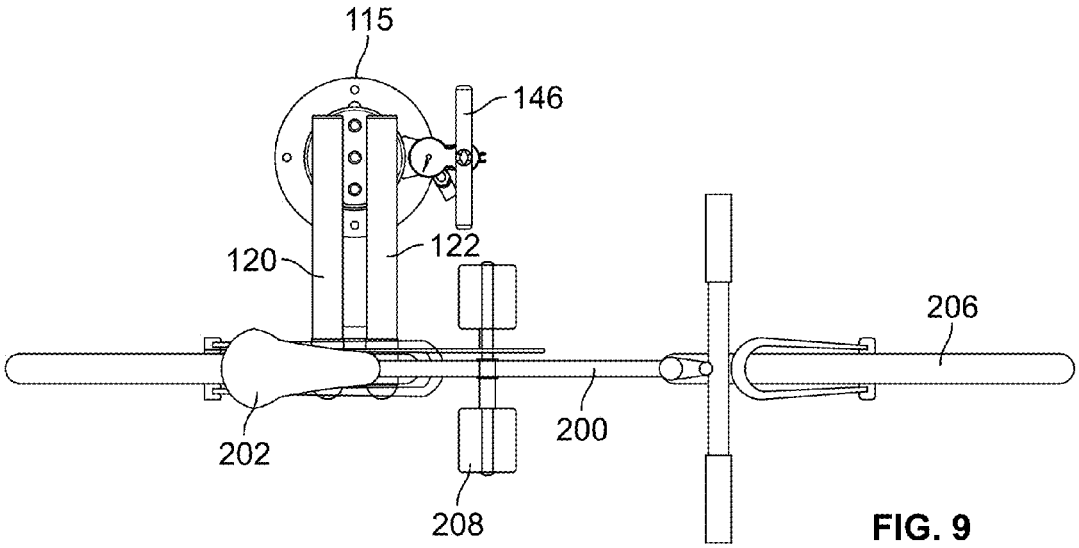
FIG. 9 is a top view of the bicycle service rack of FIG. 8.

Referring now to FIGS. 8-9, the bicycle service rack 100 is shown with a bicycle 200 positioned thereon. In this example, a seat post 128 of the bicycle 200 is positioned between the support members 120, 122, and the bicycle 200 is slid onto the support members 120, 122 so that a seat 202 of the bicycle 200 rests on the support members 120, 122.

In this position, the bicycle 20 is suspended by the bicycle service rack 100 above the ground so that the bicycle 200 can be easily serviced. For example, the tires 206 can be easily spun (e.g., by rotating pedals 208 of the bicycle 200) during servicing of the bicycle 200.

Further, the tools 138 are easily accessible and can be used to service the bicycle 200. For example, the user can select a tool 138, move it towards the bicycle 200, and use the tool 138 to service the bicycle 200. For example, a wrench can be extended from the main body 110 and used to tighten or loosen the handlebars of the bicycle 200. Further, the pump unit 140 can be used to increase the pressure of the air in the tires 206.

Figure 10:
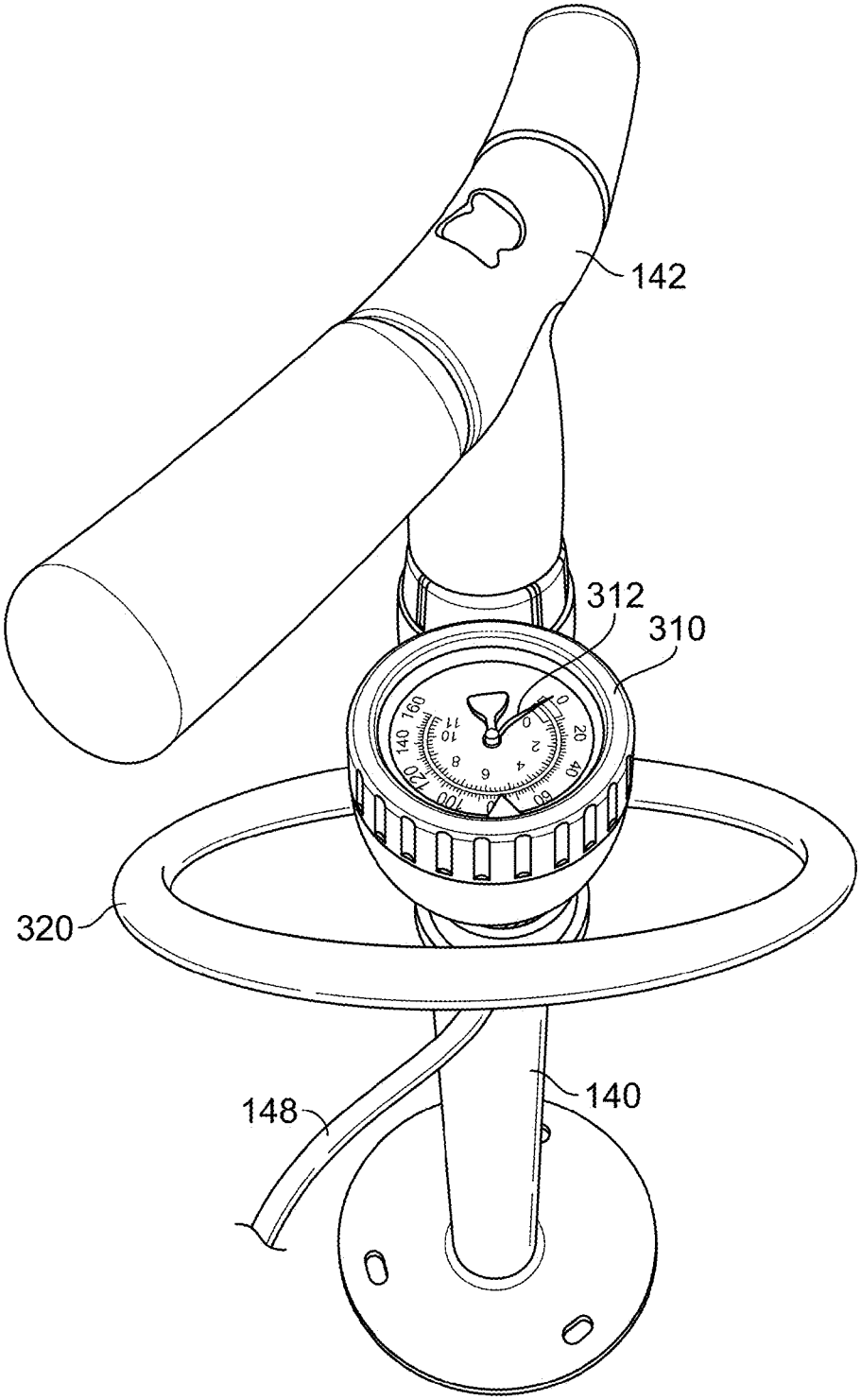
FIG. 10 is a perspective view of a portion of a pump unit of another bicycle service rack.
Figure 11:
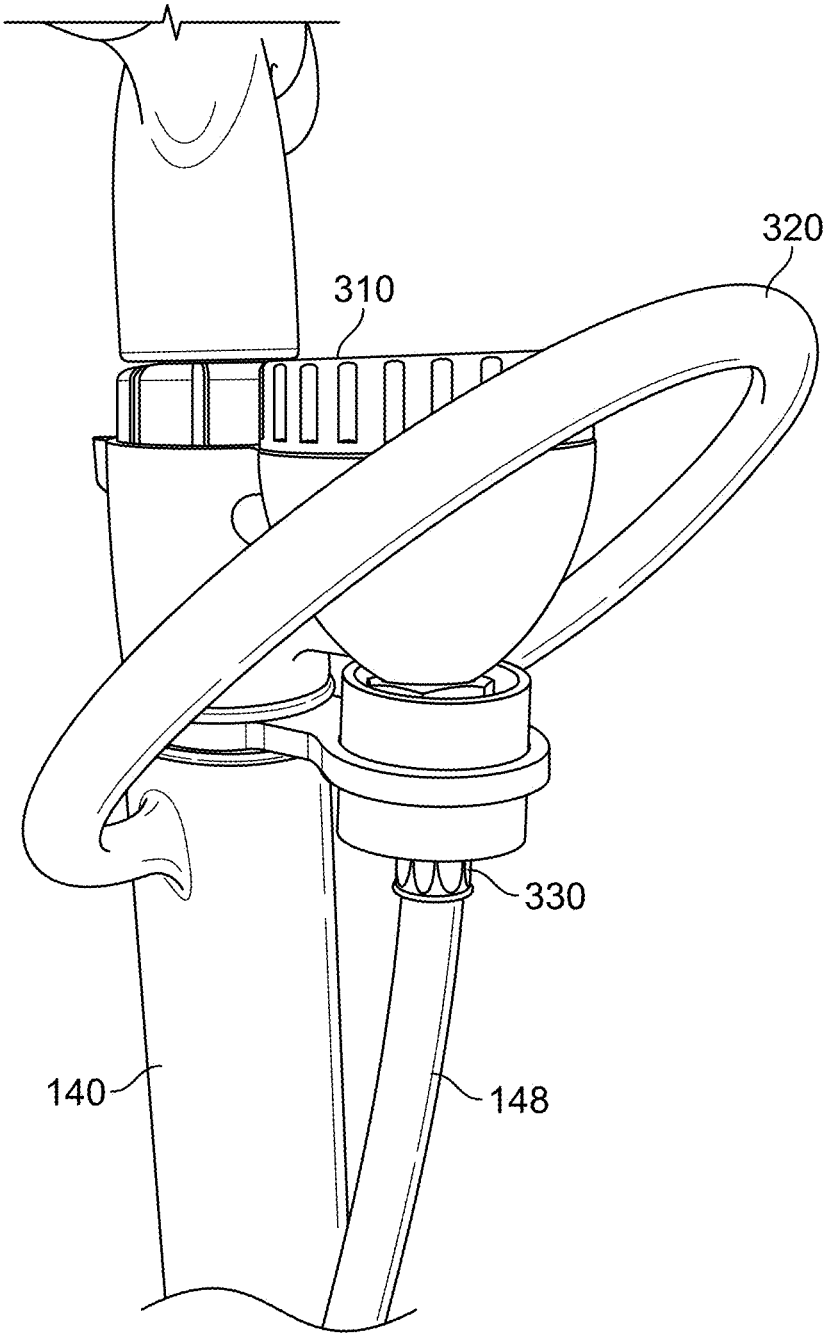
FIG. 11 is a side view of a portion of the pump unit of FIG. 10.

Referring now to FIGS. 10-11, in an alternative embodiment, the pump unit 140 also includes a pressure gauge 310. The pressure gauge 310 provides an indication of an amount of air pressure in the tires 206 so that the tires 206 can be inflated to the proper pressure. In this example, the gauge 310 includes a needle 312 that indicates the current pressure of a tire 206 connected to the pump unit 140.

In addition, the pump unit 140 includes a protection member 320 positioned to surround the gauge 310. In this example, the protection member 320 is a cylindrical member that is coupled to the pump unit 140 and extends around the gauge 310 to minimize the possibility of objects contacting the gauge 310, such as the tires 206 of the bicycle 200. This functions to protect the gauge 310 from damage. In some alternatives, a surface of the gauge 310 can be made of a material to resist scratch, such as scratch-resistant glass. Other configurations are possible, such as different shapes (e.g., square, rectangular, oblong) and materials.

Referring now to FIG. 11, in one example, the hose 148 for the pump unit 140 is shielded with stainless steel braided sheathing and is attached to the pump unit 140 using tamper resistant features requiring special tools to affix or remove. In alternative embodiments, the connection point between the air hose 148 and pump unit 140 is protected by a guard member 330 such that the hose 148 cannot be removed from the pump unit 140. In the present example embodiment, the guard member 330 is a cylindrically shaped and covers or surrounds the connection of the hose 148 and pump unit 140 such that the hose 148 cannot be decoupled from the pump unit 140 without removing the guard member 330. The hose 148 may also include a braided sheathing such that it cannot be easily cut. Other configurations are possible.

Figure 12:
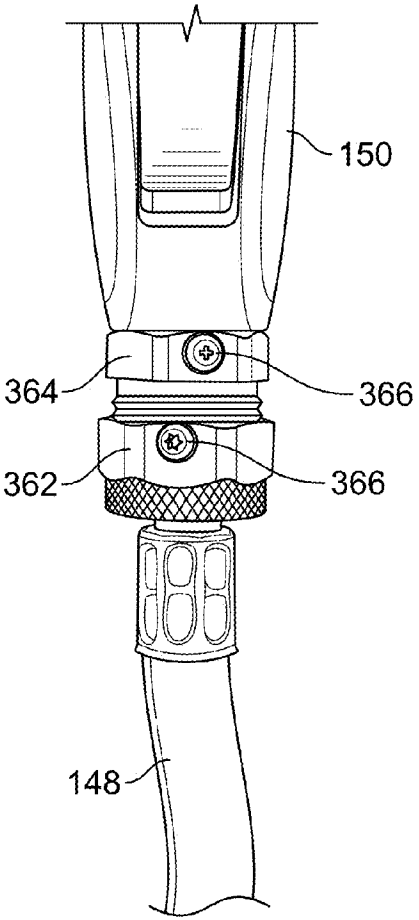
FIG. 12 is a side view of another portion of the pump unit of FIG. 10.

Similarly, referring now to FIG. 12, in one example, the other end of the hose 148 is coupled to air nozzle 150 by threaded nuts 362, 364. The nut 364 is threaded into the nut 362 to make the fluid connection between the hose 148 and the air nozzle 150. Then, set screws 366 are positioned in each of the nuts 362, 364 to resist unthreading of the nuts 362, 364. The heads of each of the set screws 366 requires a special tool to remove the set screws 366. In this configuration, the connection between the air nozzle 150 and the hose 148 is tamper-resistant.

Figure 13:
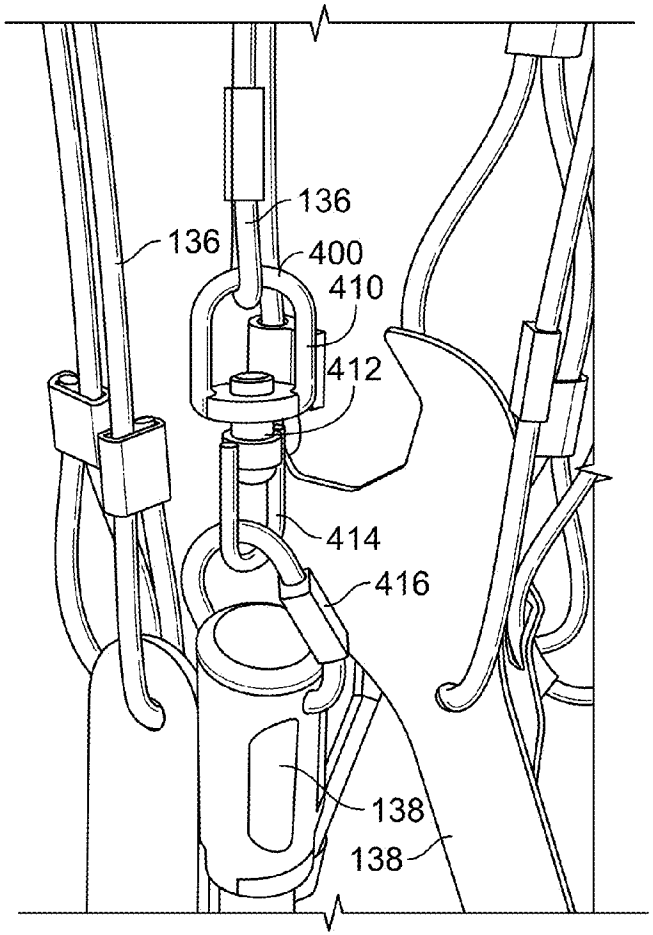
FIG. 13 is a perspective view of a portion of a set of tools of another bicycle service rack.

Referring now to FIG. 13, in another example, the tools 138 are connected to the cables 136 using a swivel member 400 that allows the tools 138 to be freely rotated, as necessary, during use. In this example, the swivel member 400 includes a first portion 410 defining a loop that is coupled to the cable 136. The first portion 410 is coupled to a second potion 414 through a swivel 412 that allows the first portion 410 to rotate freely relative to the second potion 414. The second portion 414 is, in turn, coupled to the tools. In this example, the second portion 414 defines a loop through which a cable 416 that is connected to the tool 138 extends. In some examples, only those tools that are typically twisted during use (e.g., screwdrivers and Allen wrenches) are provided on swivels. In other examples, most or all of the tools are provided with swivels.

In this configuration, the tools 138 can be easily used without causing the cables 136 to become twisted. Other similar configurations are possible.

In some examples, the main body is made of a rigid material, such as mild steel (e.g., 6.308 tubing). The support members can also be made of a mild steel (e.g., 1.5 inch schedule 40 pipe). The cables in these examples are 5/32 inch 7×19 SSAC 304 cabling stainless braided cable. The pump unit hose is 20 inch long and 0.5 inch stainless braided hose. Other materials can be used.

There are various advantages associated with the bicycle service racks described herein. For example, the racks provide a self-contained unit that can be used to service many aspects of a bicycle. This includes both service of the mechanical aspects of the bicycle, as well as the tires (e.g., by providing air to the tires). This is accomplished with a minimal footprint associated with the bicycle service rack, since all components of the bicycle service racks are integrally-formed when installed. In addition, having a single main body extending vertically upon which all components are housed or mounted further minimizes the footprint of the bicycle service racks.

In another advantage, the various components of the bicycle service racks are securely attached to minimize the possibility of tampering or damage to the components. For example, the cables are attached to the tools and the main body in such a manner to resist removal of the tools, while allowing maximum workability for the tools. Further, the air pump is securely fastened to the main body when installed and includes features to minimize tampering and damage.

The various embodiments described above are provided by way of illustration only and should not be construed as limiting. Various modifications and changes may be made to the example embodiments and applications illustrated or described herein or below without departing from the true spirit and scope of the disclosure.

What is claimed is:

1. A bicycle service rack, comprising:

a main body extending vertically from a single base;

a bicycle mount coupled to the main body, the bicycle mount being configured to hold a bicycle;

at least one cable coupled to the main body, the at least one cable being coupled to a bicycle tool; and an air pump coupled to the main body, the air pump being configured to pump air into a tire of the bicycle.

2. The bicycle service rack of claim 1, further comprising a portion configured to house the at least one cable at a point at which the at least one cable is coupled to the bicycle service rack.

3. The bicycle service rack of claim 1, wherein the main body is cylindrical.

4. The bicycle service rack of claim 1, wherein the main body defines an open interior in which the at least one cable is positioned.

5. The bicycle service rack of claim 1, wherein the bicycle mount includes first and second support members, the first and second support members extending approximately horizontally from the main body and being positioned a distance apart to accommodate a seat post of a bicycle.

6. The bicycle service rack of claim 5, wherein the at least one cable is accessible from the main body in a same direction as the direction in which the first and second support members extend from the main body.

7. The bicycle service rack of claim 6, wherein the air pump is coupled to a side of the main body.

8. The bicycle service rack of claim 1, wherein the air pump is coupled to the main body using one or more brackets.

9. The bicycle service rack of claim 1, wherein at least one of the bicycle tools is coupled to the at least one cable by a swivel member that allows the bicycle tool to rotate freely relative to the at least one cable.

10. The bicycle service rack of claim 1, wherein the air pump includes a gauge configured to indicate air pressure.

11. The bicycle service rack of claim 10, wherein the gauge includes a protection member at least partially surrounding the gauge.

12. The bicycle service rack of claim 1, wherein the main body is a single component extending from a support surface to the bicycle mount.

13. The bicycle service rack of claim 1, further comprising a QR code providing service information.

14. A bicycle service rack, comprising:

a base having a footprint that is less than one and one-half feet in length;

a main body extending vertically from the base;

first and second support members coupled to the main body, the first and second support members extending horizontally from the main body and being positioned a distance apart to accommodate a seat post of a bicycle;

a plurality of cables, each of the plurality of cables being coupled to both the main body and a bicycle tool; and an air pump coupled to the main body, the air pump being configured to pump air into a tire of the bicycle;

wherein the cables are accessible from the main body in a same direction as the first and second support members; and wherein the air pump is coupled by one or more brackets to a side of the main body.

15. The bicycle service rack of claim 14, further comprising a portion configured to house the cables at a point at which the cables are coupled to the main body.

16. The bicycle service rack of claim 14, wherein the main body is substantially cylindrical.

17. The bicycle service rack of claim 16, wherein the main body defines an open interior in which the cables are positioned.

18. The bicycle service rack of claim 14, wherein one or more of the bicycle tools is coupled to the main body by a swivel member that allows the bicycle tool to rotate freely relative to the main body.

19. A bicycle service rack, comprising:

a single base;

an integral main body extending vertically from the base;

a bicycle mount coupled to the main body, the bicycle mount being configured to hold a bicycle;

a plurality of cables, each of the cables having a first end coupled to the main body and a second end coupled to a tool; and an air pump coupled to the main body, the air pump being configured to pump air into a tire of the bicycle.

* * * * *